US006835295B1

(12) United States Patent
Jangbarwala

(10) Patent No.: US 6,835,295 B1
(45) Date of Patent: Dec. 28, 2004

(54) ELECTROWINNING CELL INCORPORATING METAL ION FILTRATION APPARATUS

(75) Inventor: Juzer Jangbarwala, Chino Hill, CA (US)

(73) Assignee: Hydromatix, Inc., Santa Fe Springs, CA (US)

( * ) Notice: Subject to any disclaimer, the term of this patent is extended or adjusted under 35 U.S.C. 154(b) by 0 days.

(21) Appl. No.: 10/009,710

(22) PCT Filed: May 26, 2000

(86) PCT No.: PCT/US00/14615

§ 371 (c)(1),
(2), (4) Date: Nov. 28, 2001

(87) PCT Pub. No.: WO00/73539

PCT Pub. Date: Dec. 7, 2000

Related U.S. Application Data

(63) Continuation of application No. 09/322,745, filed on May 28, 1999, now abandoned.

(51) Int. Cl.[7] ..... C25B 15/00; C25B 9/00

(52) U.S. Cl. ..... 205/349; 204/238; 204/276; 204/240

(58) Field of Search ..... 205/349, 574, 205/586; 204/238, 240, 276, 273

(56) References Cited

U.S. PATENT DOCUMENTS

| | | | |
|---|---|---|---|
| 4,212,722 | A | 7/1980 | Avedesian et al. |
| 4,431,496 | A | 2/1984 | Remick |
| 4,960,584 | A | 10/1990 | Brown |
| 5,116,511 | A | 5/1992 | Green et al. |
| 5,149,411 | A | 9/1992 | Castle |
| 5,183,544 | A | 2/1993 | Weber et al. |
| 5,310,486 | A | 5/1994 | Green et al. |
| 5,476,591 | A | 12/1995 | Green |
| 5,733,431 | A | 3/1998 | Green et al. |
| 6,156,186 | A | 12/2000 | Mueller et al. |
| 6,165,344 | A | 12/2000 | Green et al. |
| 6,355,175 | B1 | 3/2002 | Green et al. |

OTHER PUBLICATIONS

Undated brochure entitled "Acid Metals Water" by Desal Membrane Products, no date.

*Primary Examiner*—Donald R. Valentine
(74) *Attorney, Agent, or Firm*—Timothy J. Martin; Michael R. Henson; Rebecca A. Gegick

(57) ABSTRACT

An apparatus and method for electrowinning metal from ionic solutions is provided wherein ionic solution is subject to nanofiltration. An electrowinning cell (10) includes a reservoir (12) adapted to receive an ionic solution (14). During operation, metal ions in solution (14) electroplate onto cathode (18). Nanofilter (20) is in fluid communication with the reservoir and receives solution (14) from a location (22) proximate to the cathode (18). Retentate (52) is formed as a first portion (26) of the solution (14) which passes through the membrane (21) of the filter (20). Permeate (54) is formed as a second portion (28) of the solution (14) which passes through the membrane (21) of the filter (20) to a second region (29) on the opposite side of membrane (21) from the first region (27). Permeate (54) has a second concentration of metal ions lower than the first concentration in first portion (26). Retentate (52) is returned to the reservoir (12) to intermix with solution (14).

8 Claims, 5 Drawing Sheets

ELECTROWINNING CELL INCORPORATING METAL ION FILTRATION APPARATUS

The present application is a 35 U.S.C. 371 national phase application of international application PCT/US00/14615 designating the United States of America, which was filed on May 26, 2000 and published in English on Dec. 7, 2000 as WO 00/73539 A1, and which is a continuation of U.S. application Ser. No. 09/322,745, filed May 28, 1999, now abandoned.

FIELD OF THE INVENTION

The present invention broadly relates to the recovery of metal ions from ionic solutions. More specifically, the present invention relates to electrowinning cells for use in recovering metal ions from aqueous solutions as elementary metals. In particular, the present invention is directed to an improved electrowinning system, method and apparatus.

BACKGROUND OF THE INVENTION

Electrowinning cells are mechanisms used extensively for recovering metal ions from solutions as elementary metals. Such cells may be used, for example, in the recovery and purification of copper. The mechanism generally consists of a collection tank, an anode, a cathode and a direct current (DC) power source. The metals gain electrons, achieve a valence of zero and deposit on the cathode.

The efficiency of an electrowinning cell is directly proportional to the concentration of the metal ions in the immediate vicinity of the cathode. As metal ions deposit on the cathode as their elementary metals during the electrowinning process, however, the concentration of metal ions in the vicinity of the cathode decreases, thereby reducing the efficiency of the cell.

In order to improve the efficiency of an electrowinning cell, it is known to constantly agitate or move the ionic solutions by various mechanisms, such as by the use of fluidized beds of glass beads, rotating cathodes, and other means. These mechanisms, however, cannot significantly increase efficiency in the later stage of electrowinning when most of the metal has been recovered on the cathode and the concentration of metal ions in the solution is much lower than optimum levels.

Accordingly, this dilute solution is typically discharged from the cell and the metal ions are treated with secondary methods to concentrate the metal ions in solution again. One such method is to adjust the pH of the solution to between 4 and 6, and treat the water with a chelating type of ion exchange resin. The regenerant from the resin is then sent back to the electrowinning cell. Such a method of concentrating requires decanting the cell, adding chemicals for pH adjustment, and regenerating the solution from the ion exchange resin. The use of such secondary methods of concentration interrupts the electrowinning process and impacts the overall efficiency of the cell.

Accordingly, there remains a need to provide a new and improved electrowinning cell apparatus and system and a new and improved method of concentrating an ionic solution for use with an electrowinning cell. The present invention is directed to meeting these needs.

SUMMARY OF THE INVENTION

It is an object of the present invention to provide an efficient electrowinning cell adapted to recover metal ions from a solution.

It is another object to provide a cost effective and efficient method of concentrating metal ions in a solution for use in an electrochemical cell.

It is yet another object to provide a method and apparatus for improving the efficiency of an electrowinning cell which avoids interrupting the electrochemical process.

It is still a further object to provide an electrowinning cell which improves the efficiency of standard electrowinning cells in the later stages of electrowinning.

It is yet another object to provide a new and improved system for reducing metal ions in a solution to their corresponding elementary metals.

Yet another object is to provide an efficient and integrated electrowinning cell system.

A still further object is to provide an improvement to an electrowinning cell which circumvents the necessity for performing traditional secondary methods of concentrating metal ions in an electrowinning solution.

According to the present invention, an electrowinning cell is provided which is adapted to recover metal ions from a solution as their corresponding elementary metals. The electrowinning cell comprises a reservoir adapted to receive a solution containing metal ions at a selected concentration, an anode and a cathode disposed in the reservoir, a filter in fluid communication with the reservoir and operative to receive the solution from a location proximate to the cathode, and a return means operative to return the first portion of the solution to the reservoir. The anode and cathode are operative to establish an electric potential difference therebetween. The filter is operative to retain a first portion of the solution having a first concentration of metal ions and to remove a second portion of the solution having a second concentration of metal ions lower than the first concentration, thereby to improve the concentration of metal ions in the solution and consequently increase the efficiency of the electrowinning cell. The filter according to the present invention is preferably a nanofilter, and more preferably a nanofilter of the crossflow membrane type.

It is preferred that the electrowinning cell according to the present invention includes a solution holding tank in fluid communication with the reservoir and the filter. A filter collection tank is also preferred, where the filter collection tank is in fluid communication with the solution holding tank and the filter. A microfilter may be disposed between the nanofilter and the filter collection tank, in order to filter out undesired particles and the like which may otherwise obstruct the nanofilter. The electrowinning cell also preferably includes an electrowinning collection tank in fluid communication with the solution holding tank and the reservoir. At least one pump may be provided to circulate the solution between the components of the apparatus.

A flow-rate sensor and a valve in fluid communication with the solution may be provided. The valve has a first state allowing fluid flow and a second state preventing fluid flow. A microprocessor control may further be provided which is operative to receive data from the flow-rate sensor and to adjust the flow-rate of the solution by moving the valve between the first and second states.

The present invention is also directed to a method of concentrating metal ions in a solution for use in an electrochemical cell. The method comprises the steps of drawing a portion of a solution containing metal ions from a region proximate to a cathode in an electrochemical cell, filtering the portion of the solution thereby to create a retentate having a first concentration of metal ions and a permeate having a second concentration of metal ions lower than the first concentration, and returning the retentate to the electrochemical cell.

A system for reducing metal ions in a solution to their corresponding elementary metals is also provided. The system comprises a fluid source operative to provide a solution containing metal ions at a selected concentration, a reservoir in fluid communication with the fluid source and operative to receive the solution, an anode and a cathode each disposed in the reservoir, and a power source operative to supply electric current to the anode and the cathode. A filter in fluid communication with the reservoir includes a membrane, wherein the filter has a first region on one side of the membrane and a second region on an opposite side of the membrane. A retentate of the solution is disposed in the first region of the filter, and a permeate of the solution is disposed in the second region of the filter. The retentate has a first concentration of metal ions and the permeate has a second concentration of metal ions lower than the first concentration. A return means is operative to return the retentate to the reservoir.

The present invention also provides an improvement to an electrowinning cell operative to reduce metal ions at a selected concentration in a solution at a location proximate to a cathode in a reservoir to their corresponding elementary metals. The improvement comprises a filter apparatus in fluid communication with the reservoir and operative to draw the solution from a region proximate to the cathode and to filter the solution into a first portion having a first concentration of metal ions greater than the selected concentration and a second portion having a second concentration of metal ions lower than the selected concentration. The filter apparatus is further operative to return the first portion to the reservoir. The filter apparatus may include a filter, a valve, a conduit and a pump, and the filter may include a membrane filter of the nanofiltration range.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

The present invention generally concerns a new and efficient electrowinning cell for use in recovering metal ions from an ionic solution. In particular, the present invention incorporates a filter operative to retain a first component of the solution that contains a high concentration of metal ions while removing a second component of the solution that contains a low concentration of metal ions. This process operates to improve the concentration of metal ions in the ionic solution, thereby to increase the overall efficiency of the cell. In operation, a portion of the ionic solution is drawn from a reservoir in a region proximate to a cathode wherein an electrowinning process has reduced the concentration of metal ions in the solution. This portion of the solution is passed through the filter, whereby metal ions are retained in a retentate which is then returned to the reservoir. The permeate portion of the solution which passes through the filter and which contains a minimal concentration of metal ions is sent to waste, wherein any remaining metal ions may be recovered, if desired, by additional processes such as by further filtration or by secondary methods known in the art.

Figure 1:
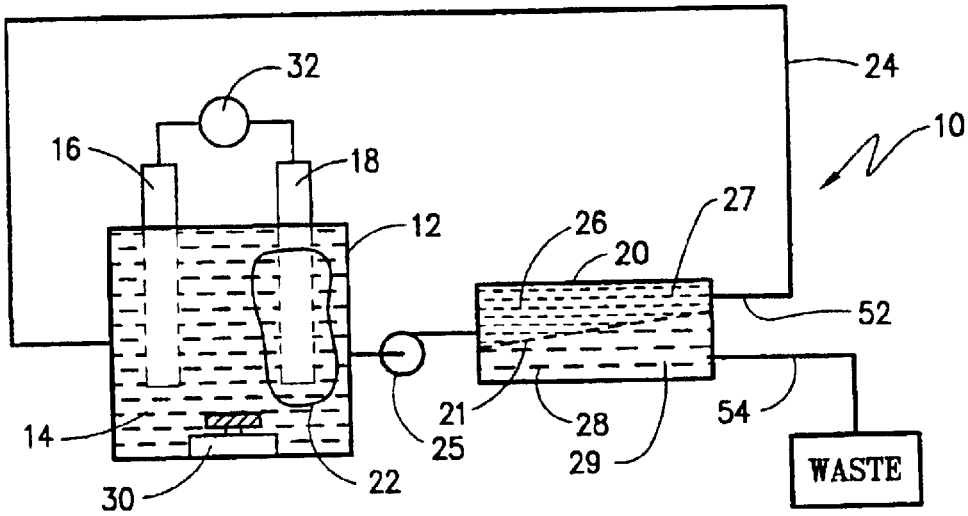
FIG. 1 is a diagrammatic view of a first embodiment of the electrowinning cell according to the present invention.

Accordingly, as is shown in FIG. 1, a first embodiment of the electrowinning cell 10 includes a reservoir 12 which is adapted to receive an ionic solution 14. Ionic solution 14 contains metal ions, such as divalent copper ions in the case of a solution containing $CuSO_4$, at a selected concentration. Reservoir 12 includes an anode 16 and a cathode 18 disposed therein. Together, reservoir 12, solution 14, anode 16 and cathode 18 form an electrochemical cell, as is known in the art. Anode 16 and cathode 18 are operative to establish an electric potential difference therebetween. This potential difference preferably is established by operation of an electrical power source 32 which is operative to supply a voltage differential to the anode 16 and the cathode 18, as is commonly known for use in electrolytic cells in the art. It should be appreciated, however, that the electric potential difference may be established by constructing the electrochemical cell as a galvanic cell as is also known in the art.

During operation of the electrowinning cell 10, metal ions in solution 14 electroplate onto cathode 18. Correspondingly, the concentration of metal ions in solution 14 at a location 22 proximate the cathode 18 decreases as metal ions are reduced to their corresponding elementary metals. Agitator 30, which is preferably disposed in reservoir 12, is provided to distribute metal ions in solution 14 more uniformly throughout reservoir 12, and in particular to agitate the solution at the location 22 proximate the cathode 18. Agitator 30 may take the form of a mixer, blender, or other means of agitating a solution, as is known in the art. Preferably, agitator 30 includes a bed of fluidized glass beads to assist fluid distribution. Alternatively, agitator 30 may be comprised of a motor operative to rotate cathode 18 about a longitudinal axis thereof, thereby to agitate solution 14 in the location 22 proximate to cathode 18.

Filter 20, which is preferably a crossflow membrane filter of the nanofiltration range, is in fluid communication with the reservoir and receives solution 14 from the location 22 proximate to the cathode 18. Pump 25 in fluid communication with the filter 20 and the reservoir 12 may provide solution 14 to filter 20 at a selected fluid pressure. Alternatively, filter 20 may receive solution 14 by gravity flow or other means known in the art for transporting fluid.

The filter 20 is operative to filter solution 14 into a retentate 52 and a permeate 54. Retentate 52 is formed as a first portion 26 of the solution 14 which remains in a first region 27 and does not pass through the membrane 21 of filter 20. First portion 26 has a first concentration of metal ions. Permeate 54 is formed as a second portion 28 of the solution 14 which passes through the membrane 21 of filter 20 to a second region 29 on the opposite side of membrane 21 from first region 27. Permeate 54 has a second concentration of metal ions which is lower than the first concentration of metal ions in the first portion 26. It should be understood that the filter 20 may be highly efficient at filtering out metal ions whereby the concentration of metal ions in the permeate may be zero or about zero and all or nearly all of the metal ions in solution 14 are retained in the retentate 52. It is contemplated, however, that minor imperfections in filter 20 will allow some metal ions to permeate therethrough. Alternatively, filter 20 may comprise a plurality of the same or less efficient filters that may be used in a multi-stage series, whereby metal ions remaining in the permeate from each stage are further concentrated by the next filter in the series. In either case, permeate 54 may be sent to waste or, if desired, may be further filtered or treated with secondary concentration methods known in the art in order to recover any metal ions contained in permeate 54.

Retentate 52 is returned to the reservoir 12 by a return means, preferably a conduit 24 in fluid communication with filter 20 and reservoir 12. Retentate 52 may be returned by operation of a pump, such as pump 25, or by gravity flow or other means known in the art. It should be understood that any return means known in the art for transporting solution may be utilized, including manual transport by container, drip valve, gravity flow, conduit, or other means. By returning retentate 52 to reservoir 12 to intermix with solution 14, the concentration of metal ions in solution 14 is improved. This improvement in the concentration of metal ions in solution 14 increases the efficiency of the electrochemical cell.

Figure 2:
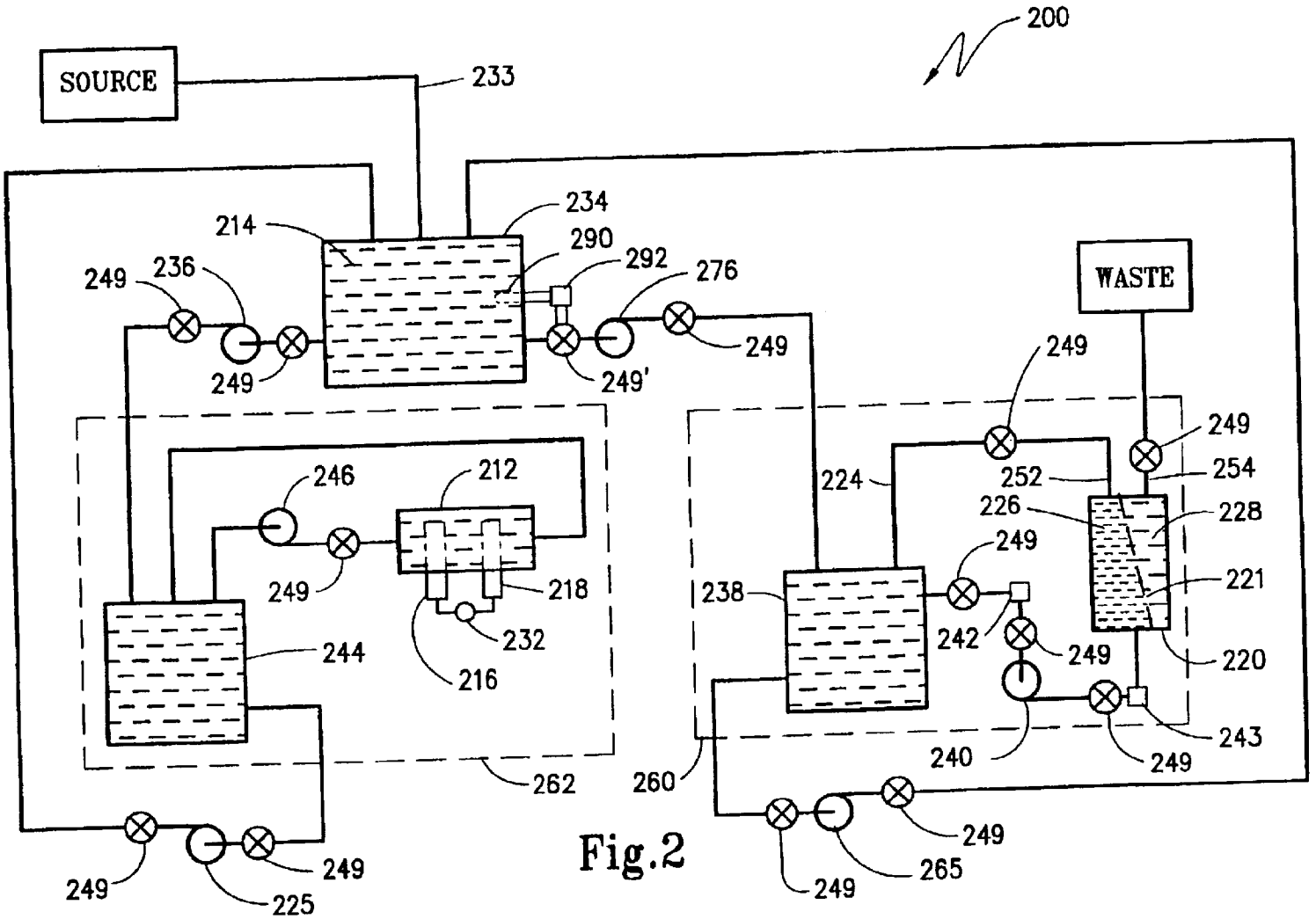
FIG. 2 is a diagrammatic view of a second embodiment of the electrowinning cell according to the present invention.

A second embodiment of the present invention is illustrated with respect to FIG. 2. In this embodiment, electrowinning system 200 comprises a fluid source 233 operative to supply a solution 214 containing metal ions at a selected concentration to a solution holding tank 234. The electrowinning system 200 forms a pair of closed circulation loops: an electrowinning loop including an electrowinning apparatus 262, and a filtration loop including a filtration apparatus 260. Both loops circulate in fluid communication with the solution holding tank 234.

Looking first to the electrowinning loop, the electrowinning collection tank 244 is in fluid communication with the solution holding tank 234 and with an electrochemical cell similar to that described with reference to FIG. 1, including a reservoir 212, a solution 214, an anode 216, a cathode 218 and a power supply 232 operative to supply a voltage differential to anode 216 and cathode 218. A pump 246 is operative to circulate solution 214 between electrowinning collection tank 244 and reservoir 212, although other circulation and/or agitation means are contemplated. Together, the electrochemical cell, the electrowinning collection tank 244, and the pump 246 make up an electrowinning apparatus 262. Valves 249 may additionally be included in electrowinning apparatus 262 to control the flow of solution 214 as desired. Pumps 225 and 236 in fluid communication with the solution holding tank 234 and the electrowinning collection tank 244 are further operative to circulate solution 214 therebetween.

Looking next to the filtration loop, the filter collection tank 238 is in fluid communication with the solution holding tank 234 and with a filter 220 operative to retain the metal ions in solution 214. Preferably, solution holding tank 234 includes a concentration sensor 290 and a controller 292 in communication with valve 249'. Concentration sensor 290 and controller 292 together are operative to monitor the concentration of metal ions in solution 214 in solution holding tank 234 and to operate valve 249 between a first and second state when the concentration of metal ions in solution 214 is below or above a selected concentration, respectively. The selected concentration corresponds to a concentration above which filter apparatus 260 does not perform optimally. In particular, it is preferred that valve 249' be moved into a first state allowing fluid flow to the filtration loop when the concentration of metal ions, such as divalent copper ions, is at or below 500 ppm (0.5 g/L $Cu^{2+}$). When the concentration of metal ions is above 500 ppm, it is preferred that valve 249' be moved into a second state preventing fluid flow to the filtration loop. Once the electrowinning process in the electrowinning loop has reduced the concentration of metal ions to a concentration within the optimal range for filter apparatus 260, valve 249' is again moved into the first state whereby solution 214 is concentrated by the filtration loop.

A pump 240 may be provided that is operative to provide solution 214 to filter 220 at a selected fluid pressure, preferably about 150 psi. In addition, microfilters 242 and 243 are disposed between filter collection tank 238 and filter 220 and are operative to remove particles which might otherwise clog filter 220. Preferably, microfilter 242 is a 5 micron filter and microfilter 243 is a 1 micron filter.

Filter 220 concentrates metal ions in solution 214 in a manner similar to that described with reference to filter 20 in FIG. 1. Filter 220 is operative to retain a first portion 226 of solution 214 and to allow a second portion 228 of solution 214 to permeate filter 220. First portion 226 contains a higher concentration of metal ions than does second portion 228, which may be sent to waste as permeate 254 or which may be treated with secondary methods of concentration as desired. Fluid source 233 may intermittently or constantly replenish the volume of solution 214 as permeate 254 is removed from the system. Preferably, solution 214 is provided by fluid source 233 in a volume and at a flow rate equal to the volume and flow rate at which permeate 254 is removed from the system.

First portion 226 is returned to filter collection tank 238 as retentate 252 by conduit 224. Together, filter collection tank 238, filter 220, conduit 224, and associated components such as pump 240, microfilters 242 and 243, comprise filter apparatus 260. Filter apparatus 260 may further include valves 249 or other means for controlling fluid flow as is known in the art. Pumps 265 and 276 are operative to further circulate solution 214 between filter apparatus 260 and solution holding tank 234, and ultimately between filter apparatus 260 and electrowinning apparatus 262. This arrangement allows for a highly efficient means of concentrating metal ions in solution 214 and for mixing and distributing solution 214 throughout the entire system, such as to the electrowinning apparatus 262 wherein the electrowinning process reduces metal ions to their corresponding elementary metals.

Figures 3, 4:
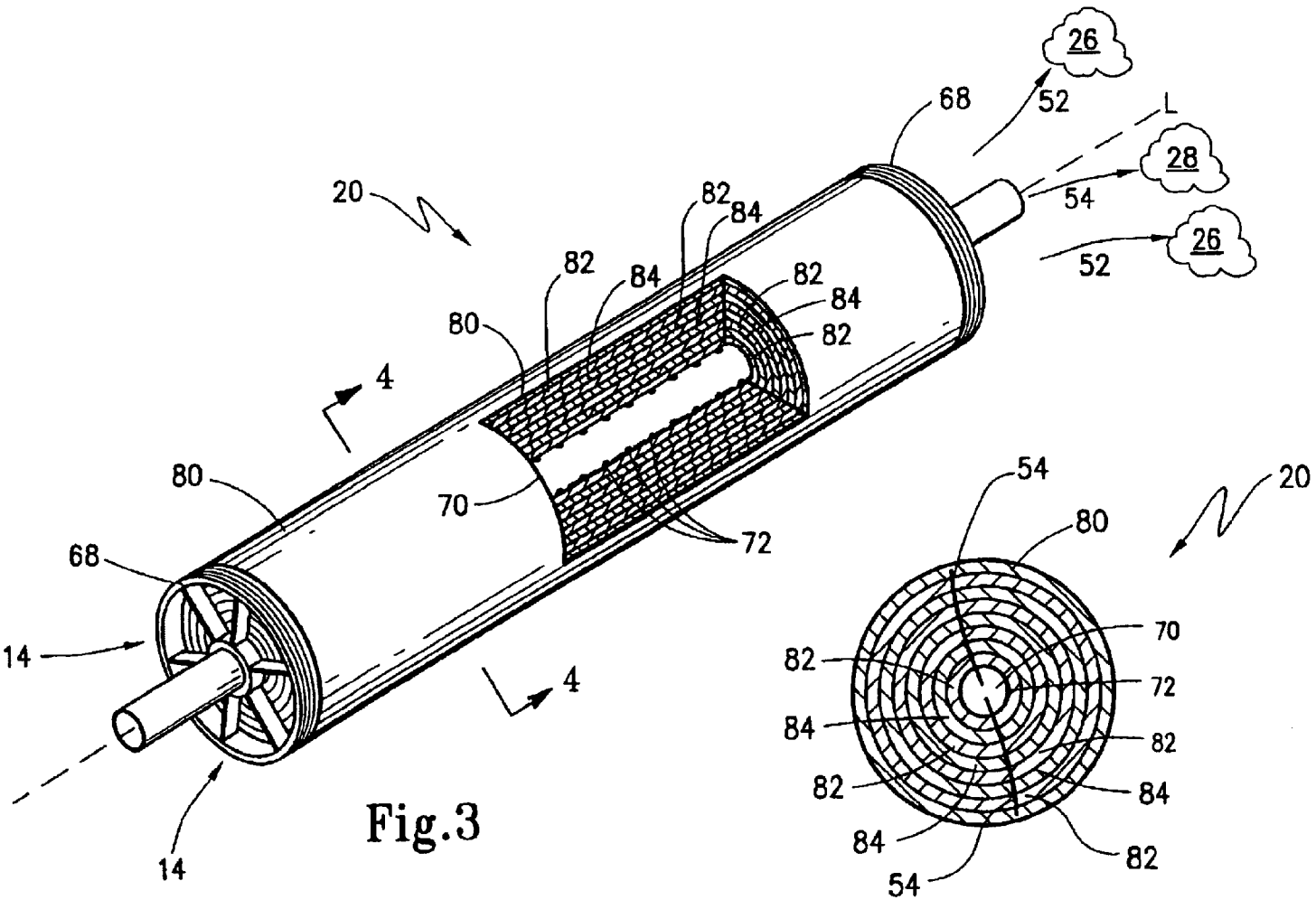
FIG. 3 is a perspective view in partial cross-section showing a filter for use in the electrowinning cell of the present invention, wherein a cross-sectional portion of the outerwrap, membrane layers and feed spacers has been removed.
FIG. 4 is a cross-sectional view about lines 4—4 of the filter in FIG. 3.
Figure 5:
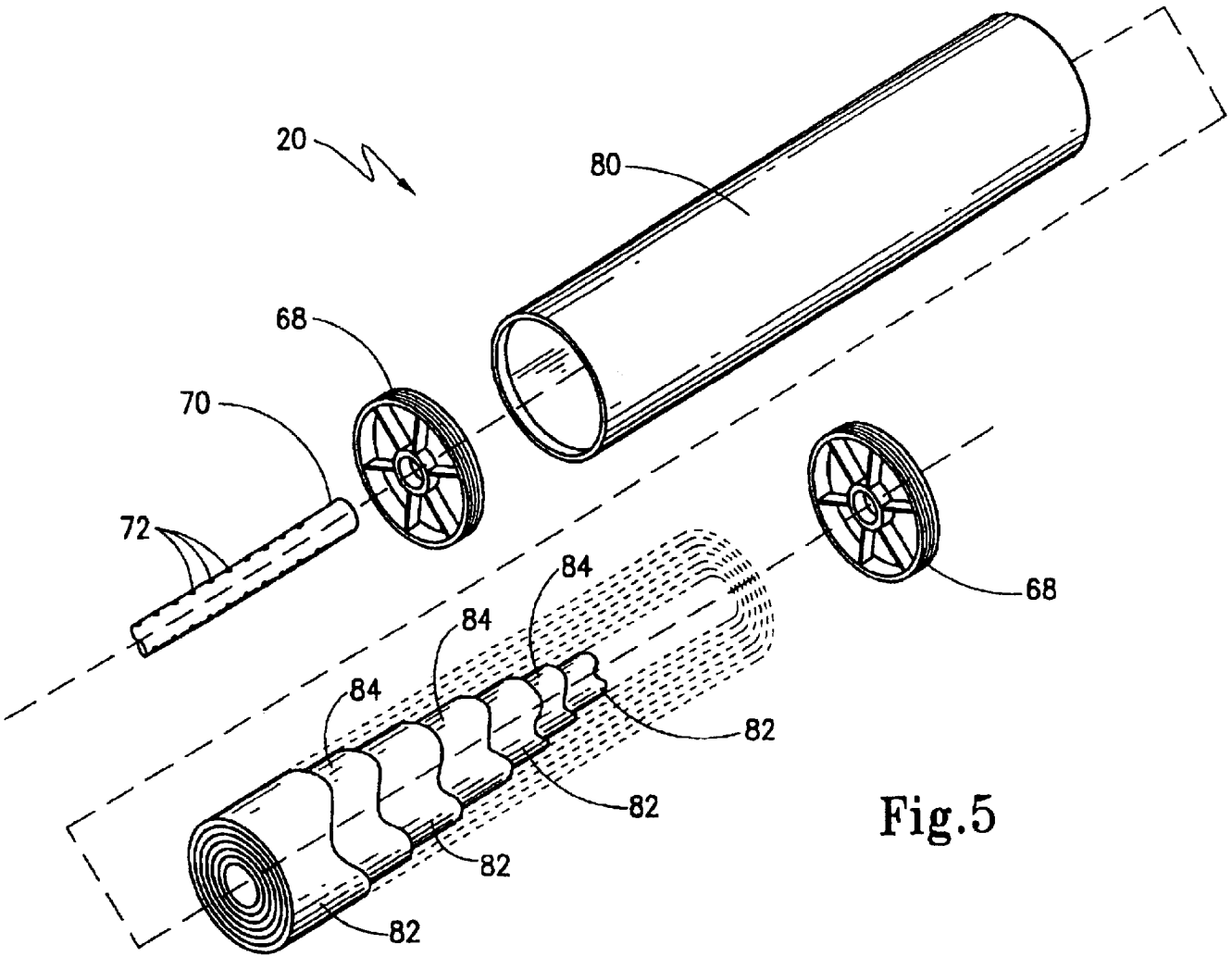
FIG. 5 is an exploded view in perspective of the filter in FIG. 3.

The filter 20 according to the present invention may be more fully understood with reference to FIGS. 3–5. Preferably, filter 20 is a nanofilter of the crossflow membrane variety. The preferred filter is a Desal™ proprietary membrane product manufactured by Osmonics, 760 Shadowridge Dr., Vista, Calif. 92083-7986. The Desal filter is a spiral wound module design incorporating a proprietary nanofiltration thin-film membrane (TFM®), designated the Desal-5™. This membrane preferentially rejects divalent and multivalent anions, while monovalent ion rejection is dependent upon feed concentration and composition. The membrane is characterized by a molecular weight cutoff of 150–300 daltons for uncharged organic molecules. Operating paramaters are as follows: operating pH of between 2.0–11.0 and cleaning pH of between 1.0–11.5; chlorine tolerance of 1,000 ppm-hours, such that dechlorination is recommended; maximum temperature is 122° F. (50° C.) with standard element construction and up to 158° F. (70° C.) with special element construction; typical operating pressure is 70–400 psig (483–2,758 kPa) with a maximum pressure of 500 psig (3,448 kPa).

As shown in FIGS. 3–5, filter 20 includes a generally cylindrical outerwrap 80 which is preferably constructed of fiberglass. Outerwrap 80 surrounds membrane layers 82, also generally cylindrical, having a common central longitudinal axis L with outerwrap 80. Membrane layers 82 comprise cylinders of graduated radii which fit within outerwrap 80 in telescoping relation. Each of membrane layers 82 is separated from an adjacent membrane layer by feed spacers 84. Anti-telescoping devices 68 engage the ends of outerwrap 80 and membrane layers 82 thereby to prevent undesired telescoping extension of membrane layers 82 outside of outerwrap 80. Membrane layers 82 preferably further include a membrane, a membrane backing material, a carrier material, a feed channel spacer, and an outer layer spacer material. The membrane is preferably a nanofilter membrane operative to retain metal ions.

Filter 20 further includes a perforated central tube 70 having apertures 72 in a sidewall thereof. Perforated central tube 70 extends along longitudinal axis L and is surrounded by membrane layers 82 and feed spacers 84 in a spiral wound design.

The operation of filter 20 may be seen with reference to FIGS. 3 and 4. As shown in FIG. 3, solution 14 is passed through a first anti-telescoping device 68 and through membrane layers 82 and feed spacers 84. As shown in FIG. 4, permeate 54 permeates through membrane layers 82 and feed spacers 84 in a crossflow direction to arrive at perforated central tube 70, where permeate 54 enters perforated central tube 70 at apertures 72. Again with reference to FIG. 4, permeate 54 flows through perforated central tube 70 to be expelled from filter 20 as second portion 28. Retentate 52, which does not permeate membrane layers 82 and feed spacers 84 in a crossflow direction, is expelled from filter 20 through a second anti-telescoping device 68 as first portion 26 which has a higher concentration of metal ions than does second portion 28. It should further be appreciated that retentate 52 will have a higher concentration of metal ions than does solution 14, and that permeate 54 will have a lower concentration of metal ions than does solution 14.

Figure 6:
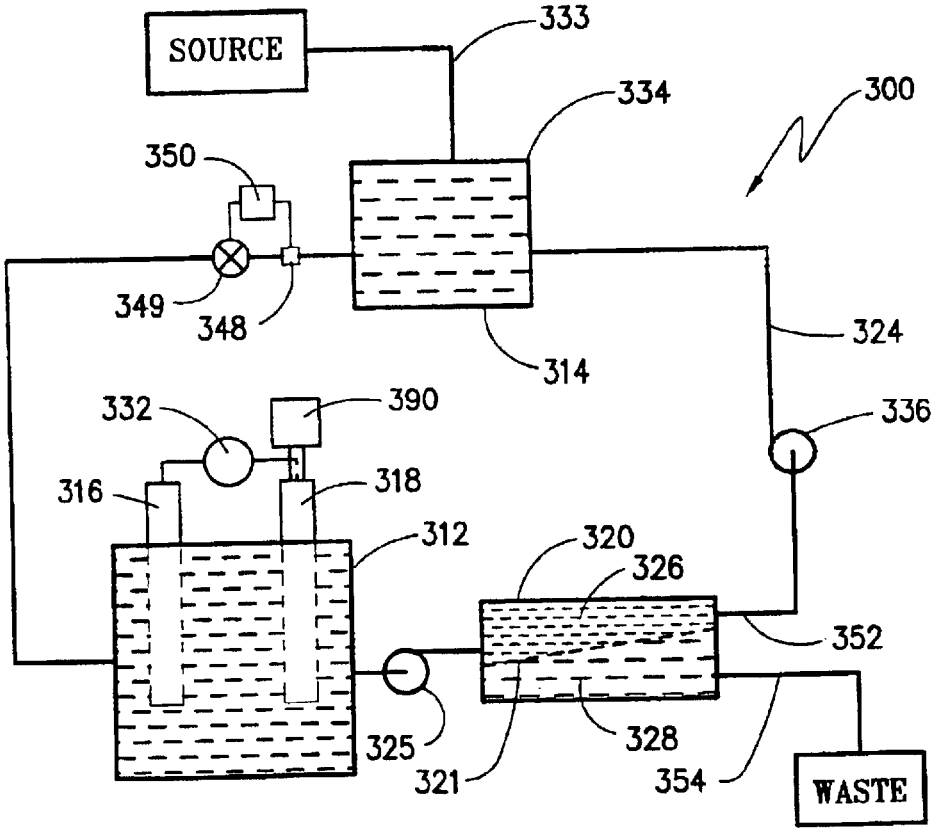
FIG. 6 is a diagrammatic view of a third embodiment of the present invention.

A third embodiment of the present invention is shown in FIG. 6. Electrowinning cell 300 includes a fluid source 333 which supplies solution 314 to solution holding tank 334. Solution holding tank 334 is in fluid communication with reservoir 312 and filter 320. Anode 316 and cathode 318 are disposed in reservoir 312. Motor 390 in mechanical communication with cathode 318 is operative to rotate cathode 318 about a longitudinal axis thereof. Electrical power supply 332 is operative to supply a voltage differential to anode 316 and cathode 318 and to establish an electrical potential difference therebetween. Pump 325 is operative to provide solution 314 to filter 320 at a selected fluid pressure.

Filter 320 is operative to filter solution 314 into a first portion 326 and a second portion 328 by allowing second portion 328 to permeate through membrane 321, as discussed above with respect to filters 20 and 220. Pump 336 is operative to return retentate 352 to solution holding tank 334 by conduit 324. Permeate 354 is sent to waste or treated by further filtration or secondary methods of concentration as desired. Solution holding tank 334 or reservoir 312 may further include apparatus for agitating solution 314 as discussed above.

Electrowinning cell 300 further includes a flow-rate sensor 348 and a valve 349 in fluid communication with solution 314. Valve 349 has a first state allowing fluid flow and a second state preventing fluid flow. Microprocessor control 350 which is in electrical communication with flow-rate sensor 348 and valve 349 is operative to receive data from flow-rate sensor 348 and to adjust the flow-rate of solution 314 by moving valve 349 between the first and second states.

Figure 7:
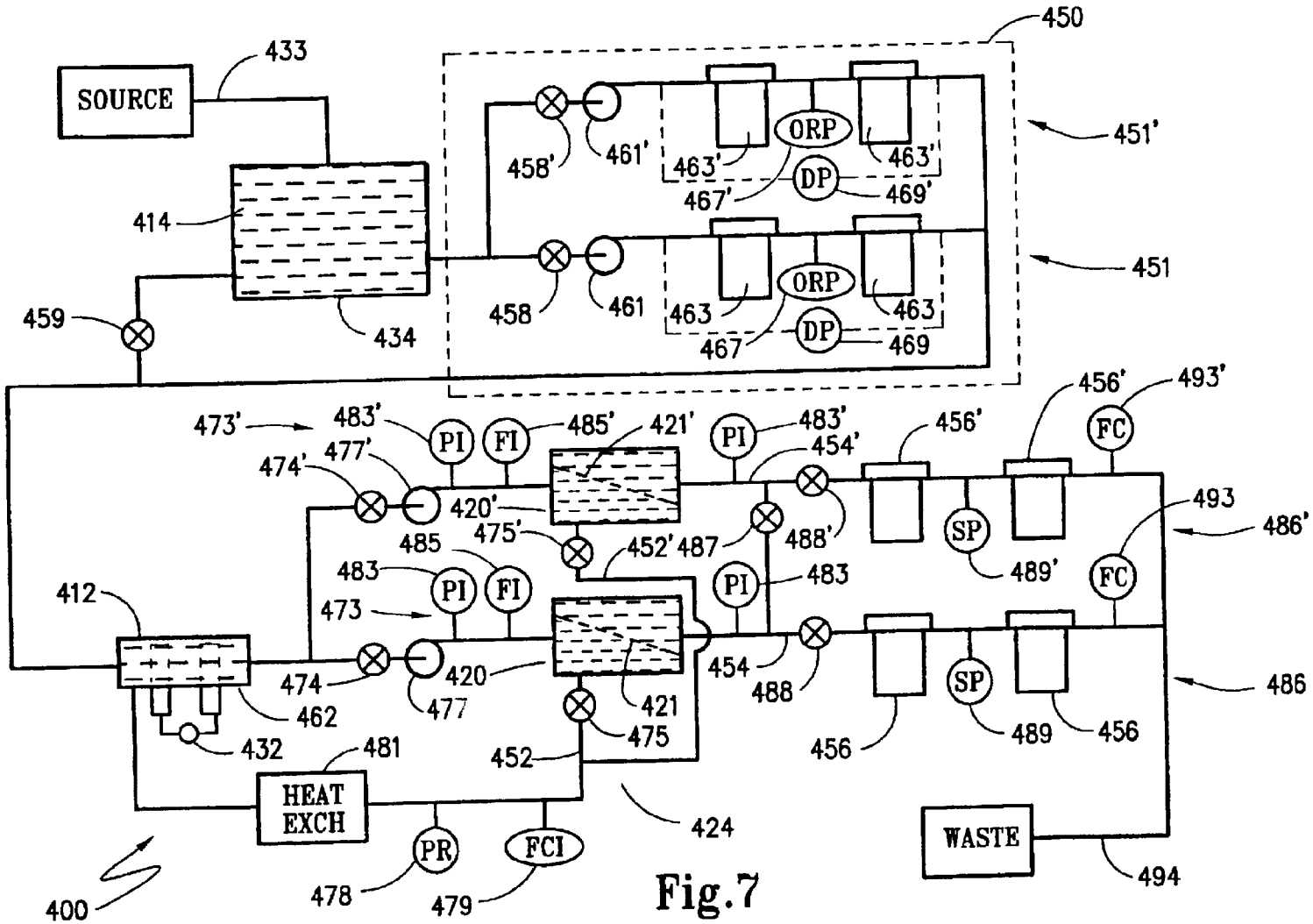
FIG. 7 is a diagrammatic view of a fourth embodiment of the present invention.

A fourth embodiment of an electrowinning system 400 is shown with respect to FIG. 7. This embodiment is particularly adapted for use with the rinse from semiconductor manufacturing processes, and in particular for recovering copper from the rinsewater stream from processes for electroplating copper onto semiconductor wafers. The semiconductor industry is continually seeking new ways for improving and increasing the speed of integrated circuits. One method currently employed by the semiconductor industry is the process of making copper interconnects on integrated circuits, rather than the former method of using aluminum interconnects. Copper interconnects provide the advantages of faster speed and better heat dissipation in integrated circuits. The use of copper, however, presents certain problems in the fabrication process in that the wastewater generated from the fabrication process contains copper instead of aluminum, making the wastewater toxic. The rinsewater from the electroplating process is very similar to rinsewater found in plating and circuit shops where copper is plated on metals and circuit boards. In particular, the rinsewater contains various components that present a significant challenge for waste disposal efforts.

The fourth embodiment of the present invention, as exemplified in FIG. 7, is particularly adapted to the rinse from electroplating of copper onto semiconductor wafers. This embodiment includes a double train, continuous system, such that alternating operating and standby loops permit continuous operation of electrowinning system 400. Because some of the copper electroplating solutions contain hydrogen peroxide, an optional peroxide removal loop 450 may be included in electrowinning system 400. Additionally, this embodiment includes ion exchange resins, preferably in disposable cartridges 456 and 456', to remove additional copper ions from permeate 454 and 454' that are not rejected by membranes 421 and 421' of filters 420, and 420' respectively, thereby to assure compliance with disposal standards for the waste stream 494.

As shown in FIG. 7, fluid source 433 provides ionic solution 414 to solution holding tank 434, such as by gravity drain into tank 434. Solution 414 may be the rinsewater stream from various forms of copper electroplating, including copper electroplating used in semiconductor manufacturing processes. If peroxide is present in solution 414, the optional peroxide removal loop 450 may be used to reduce the presence of peroxide. In particular, one of valves 458 and 458' may be opened while valve 459 remains closed, thereby to direct solution 414 through peroxide removal loop 450. If peroxide is not present in the fluid source with which electrowinning system 400 is used, it should be understood that optional peroxide removal loop 450 need not be included in electrowinning system 400. Alternatively, if peroxide is not present in solution 414, valves 458 and 458' may both be closed, and valve 459 opened, thereby to direct solution 414 directly to an electrowinning apparatus 462 of the type as described above with respect to other embodiments of the present invention.

The operation of peroxide removal loop 450 involves passing solution 414 through either the peroxide operating loop 451, shown as the lower path, or peroxide standby loop 451', shown as the upper path. It should be appreciated that one of loops 451 and 451' may be serviced while the other is in use, such that peroxide removal loop 450 may provide continuous operation to remove peroxide from solution 414. When valve 458 is open, pump 461 is activated thereby to pump solution 414 through activated carbon cartridges 463 in operating loop 451. Activated carbon cartridges 463 preferably contain powdered and packed activated carbon, known in the industry as carbon blocks, which are operative to remove peroxide from solution 414. Cartridges 463 are preferably replaceable, disposable cartridges that may be placed within and removed from the fluid path. Oxidation reduction potential sensor 467 is disposed in the fluid path between two activated carbon cartridges 463 and is operative to detect an oxidation reduction potential in fluid 414, signifying that the upstream one of activated carbon cartridges 463 is exhausted. The downstream one of activated carbon cartridges 463 provides a backup system to remove any peroxide from solution 414 that is not removed by the upstream one of activated carbon cartridges 463.

When oxidation reduction potential sensor 467 detects an oxidation reduction potential signifying that the upstream one of cartridges 463 is exhausted, valve 458 is closed and valve 458' is opened thereby to redirect solution 414 to standby loop 451', which has a pump 461', activated carbon cartridges 463', and oxidation reduction potential sensor 467', which function in the same manner as the corresponding elements of operating loop 451. It should be appreciated that while solution 414 is being directed through standby loop 451', operating loop 451 may be serviced such as by changing both of cartridges 463 in operating loop 451. Solution 414 may be redirected back through operating loop 451 once operating loop 451 has been serviced, or solution 414 may continue to be directed through standby loop 451' until such time as oxidation reduction potential sensor 467' detects an oxidation reduction potential signifying that the upstream one of cartridges 463' is exhausted. Standby loop 451' may be serviced once solution 414 is redirected to operating loop 451.

A differential pressure switch 469 may also be provided, which is operative to detect a pressure differential across activated carbon cartridges 463. A selected pressure differential measured across cartridges 463 may indicate that a buildup of solids in solution 414 has blocked the fluid flow path through cartridges 463. If such a selected pressure differential is measured by differential pressure switch 469, valve 458 is closed and valve 458' is opened, thereby to redirect solution 414 to standby loop 451' so that operating loop 451 may be serviced, such as by removing any blockage from the flow path or by replacing cartridges 463. Differential pressure switch 469' operates similarly with respect to standby loop 451'.

Solution 414 from which peroxide has been removed is next directed to reservoir 412 of electrowinning apparatus 462, which functions in the manner described above with respect to the other embodiments of the present invention. As mentioned above, when peroxide is not present in the rinsewater stream, solution 414 may be sent directly to reservoir 412 through valve 459. Power source 432 may include a rectifier operative to apply DC current to electrowinning apparatus 462 for electroplating of copper, as known in the art.

Solution 414 is drawn from electrowinning apparatus 462 and passed through one of filtration operating loop 473, shown as the lower path, or filtration standby loop 473' shown as the upper path, or through both simultaneously. Operating loop 473 and standby loop 473' together provide a continuously operating filtration system whereby one loop may be serviced while the other loop continues to provide metal ion filtration of solution 414. It should be appreciated that each of operating loop 473 and standby loop 473' may include a single filter 420 or 420', or may include a plurality of filters in a multi-stage series, whereby metal ions remaining in the permeate from each stage are further concentrated by the next filter in the series thereby to further concentrate solution 414.

Solution 414 is passed through operating loop 473 by opening valves 474 and 475 and by turning on pump 477. Pump 477 is operative to provide solution 414 to membrane 421 of filter 420 at a pressure preferably of 120 to 200 psi. Pressure indicators 483 and flow indicator 485 may be used to monitor the pressure and flow of fluid 414 across membrane 421. Filter 420 functions in the same manner as described above with respect to the other embodiments of the present invention to provide a retentate 452 and a permeate 454. Retentate 452 is returned to reservoir 412 via conduit 424. When a multi-stage series of filters is used, the retentate from each filter may be returned to reservoir 412. Pressure regulator 478 and flow control and indicator 479 may be used to monitor and regulate the return of retentate 452 to reservoir 412. Additionally, retentate 452 may be passed through a heat exchanger 481, thereby to dissipate excess thermal energy in retentate 452.

When filter 420 requires service, solution 414 may be directed to standby loop 473' by closing valves 474 and 475 and by opening valves 474' and 475'. Pump 477', pressure indicators 483', flow indicator 485', and membrane 421' of filter 420' function in the manner of the corresponding elements of operating loop 473. Retentate 452' is returned to reservoir 412 in the same manner as discussed with respect to retentate 452. When operating loop 473 has been serviced, solution 414 may be redirected thereto. Alternatively, solution 414 may continue to run through standby loop 473' until standby loop 473' requires service, at which time solution 414 may be redirected to operating loop 473.

Because nanofiltration membranes 421 and 421' may reject only approximately 98–99% of copper ions, a polisher loop may be included to polish permeate 454 from filtration operating loop 473 or permeate 454' from the filtration standby loop 473'. A polisher operating loop 486, shown as the lower path, and a polisher standby loop 486' shown as the upper path, may be provided, to which permeate 454 or permeate 454' may be directed by opening and closing appropriate ones of valves 487, 488 and 488'.

Operating loop 486 includes ion-exchange resin cartridges 456, which are preferably disposable cartridges that may be placed in and removed from the fluid flow path. Ion exchange resin cartridges 456 are operative by ion-exchange to remove copper ions remaining in permeate 454 or permeate 454', thereby to further reduce the copper ion concentration thereof. Ion-exchange resins for use with the present invention include those manufactured by Reilly Industries, Inc., 1500 South Tibbs Avenue, Indianapolis, Ind., such as those manufactured under the tradenames Reillex™ 402 and 425. The vinylpyridine structure of these resins makes them extremely resistant to attack by oxidizing agents, as compared for example to conventional resins that are crosslinked by divinylbenzene. Additionally, the vinylpyridine resins are very selective to transition and heavy metals, such as copper. Other ion exchange resins contemplated for use with the present invention are discussed, for example, in U.S. Pat. Nos. 5,281,631, 5,449,462 and 5,539,003 to Horwitz et al., which relate to phosphonic acid based ion exchange resins. It should be understood that, while cartridges 456 are preferably disposable, the ion exchange resins in cartridges 456 may alternatively be regenerated such as by addition of acid, such that cartridges 456 may be reusable with the present invention.

An online copper monitor at sample port 489 may be used to detect copper leakage from the upstream one of ion exchange cartridges 456, signifying exhaustion of that cartridge. The downstream one of cartridges 456 serves as a backup to remove copper ions remaining in permeate 454 or 454' after passing through the upstream cartridge. When copper is detected at sample port 489, appropriate ones of valves 487, 488 and 488' are opened and closed to redirect permeate 454 or 454' to standby loop 486'. Operating loop 486 may then be serviced, such as by replacing or regenerating each of cartridges 456. Cartridges 456' and sample port 489' of standby loop 486' operate in a manner similar to the corresponding elements of operating loop 486. Permeate 454 or 454' may be redirected to operating loop 486 after servicing thereof, or permeate 454 or 454' may continue to run through standby loop 486' until copper is detected at sample port 489, at which time permeate 454 or 454' may be directed to operating loop 486 such that standby loop 486' may be serviced. Polished waste stream 494 is sent through flow control 493 or 493', which may be a 1/2 gpm orifice, and thereon to waste for appropriate disposal thereof.

It should be apparent from the foregoing that the present invention contemplates variations in the positioning of the reservoir, the filter, and any additional components chosen for inclusion in the electrowinning system, such as various tanks, pumps, valves, cartridges, sensors, conduits, agitators, and the like.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. An electrowinning cell adapted to recover metal ions from a solution as their corresponding elementary metals, comprising:

(a) a reservoir adapted to receive a solution containing metal ions at a selected concentration;

(b) an anode and a cathode disposed in said reservoir, said anode and cathode operative to establish an electric potential difference therebetween;

(c) a filter in fluid communication with said reservoir and operative to receive the solution from a location proximate to said cathode, wherein said filter is operative to retain a first portion of the solution having a first concentration of metal ions and to remove a second portion of the solution having a second concentration of metal ions lower than the first concentration;

(d) return means operative to return the first portion of the solution to said reservoir; and (e) an activated carbon in fluid communication with said reservoir, said activated carbon operative to reduce a concentration of hydrogen peroxide in the solution.

2. An electrowinning cell adapted to recover metal ions from a solution as their corresponding elementary metals, comprising:

(a) a reservoir adapted to receive a solution containing metal ions at a selected concentration;

(b) an anode and a cathode disposed in said reservoir, said anode and cathode operative to establish an electric potential difference therebetween;

(c) a filter in fluid communication with said reservoir and operative to receive the solution from a location proximate to said cathode, wherein said filter is operative to retain a first portion of the solution having a first concentration of metal ions and to remove a second portion of the solution having a second concentration of metal ions lower than the first concentration;

(d) return means operative to return the first portion of the solution to said reservoir; and (e) an ion-exchange resin in fluid communication with said filter, said ion-exchange resin adapted to receive said second portion of the solution and operative to remove metal ions from said second portion of the solution thereby to provide a waste solution having a third concentration of metal ions lower than the second concentration.

3. An electrowinning cell adapted to recover metal ions from a solution as their corresponding elementary metals, comprising:

(a) a reservoir adapted to receive a solution containing metal ions at a selected concentration;

(b) an anode and a cathode disposed in said reservoir, said anode and cathode operative to establish an electric potential difference therebetween;

(c) a filter in fluid communication with said reservoir and operative to receive the solution from a location proximate to said cathode, wherein said filter is operative to retain a first portion of the solution having a first concentration of metal ions and to remove a second portion of the solution having a second concentration of metal ions lower than the first concentration;

(d) return means operative to return the first portion of the solution to said reservoir;

(e) a solution holding tank in fluid communication with said reservoir and operative to provide the solution thereto, and including an activated carbon cartridge disposed in fluid communication with said solution holding tank and said reservoir and adapted to receive said solution, said activated carbon cartridge operative to reduce a concentration of hydrogen peroxide in the solution, and further including an ion-exchange resin in fluid communication with said filter, said ion-exchange resin adapted to receive said second portion of the solution and operative to remove metal ions from said second portion of the solution thereby to provide a waste solution having a third concentration of metal ions lower than the second concentration.

4. A method of concentrating metal ions in a solution for use in an electrochemical cell, comprising the steps of:

(a) drawing a portion of a solution containing metal ions from a region proximate to a cathode in an electrochemical cell;

(b) filtering the portion of the solution thereby to create a retentate having a first concentration of metal ions and a permeate having a second concentration of metal ions lower than the first concentration;

(c) returning said retentate to said electrochemical cell; and (d) contacting said permeate with an ion-exchange resin operative to remove metal ions therefrom thereby to create a waste solution having a third concentration of metal ions lower than the second concentration.

5. A method of concentrating metal ions in a solution for use in an electrochemical cell, comprising the steps of:

(a) drawing a portion of a solution containing metal ions from a region proximate to a cathode in an electrochemical cell;

(b) filtering the portion of the solution thereby to create a retentate having a first concentration of metal ions and a permeate having a second concentration of metal ions lower than the first concentration;

(c) returning said retentate to said electrochemical cell; and (d) contacting the solution with activated carbon operative to reduce a concentration of hydrogen peroxide in the solution.

6. A system for reducing metal ions in a solution to their corresponding elementary metals, comprising:

(a) a fluid source operative to provide a solution containing metal ions at a selected concentration;

(b) a reservoir in fluid communication with said fluid source and operative to receive the solution;

(c) an anode disposed in said reservoir;

(d) a cathode disposed in said reservoir;

(e) a power source operative to supply electric current to said anode and said cathode;

(f) a crossflow membrane filter in fluid communication with said reservoir and including a membrane, said filter having a first region on one side of said membrane and a second region on an opposite side of said membrane;

(g) a retentate of the solution disposed in the first region of the filter, said retentate having a first concentration of metal ions;

(h) a permeate of the solution disposed in the second region of the filter, said permeate having a second concentration of metal ions lower than the first concentration; and (i) a return means operative to return said retentate to said reservoir.

7. A system for reducing metal ions in a solution to their corresponding elementary metals, comprising:

(a) a fluid source operative to provide a solution containing metal ions at a selected concentration wherein said solution includes activated carbon disposed therein;

(b) a reservoir in fluid communication with said fluid source and operative to receive the solution;

(c) an anode disposed in said reservoir;

(d) a cathode disposed in said reservoir;

(e) a power source operative to supply electric current to said anode and said cathode;

(f) a filter in fluid communication with said reservoir and including a membrane, said filter having a first region on one side of said membrane and a second region on an opposite side of said membrane;

(g) a retentate of the solution disposed in the first region of the filter, said retentate having a first concentration of metal ions;

(h) a permeate of the solution disposed in the second region of the filter, said permeate having a second concentration of metal ions lower than the first concentration; and (i) a return means operative to return said retentate to said reservoir.

8. A system for reducing metal ions in a solution to their corresponding elementary metals, comprising:

(a) a fluid source operative to provide a solution containing metal ions at a selected concentration;

(b) a reservoir in fluid communication with said fluid source and operative to receive the solution;

(c) an anode disposed in said reservoir;

(d) a cathode disposed in said reservoir;

(e) a power source operative to supply electric current to said anode and said cathode;

(f) a filter in fluid communication with said reservoir and including a membrane, said filter having a first region on one side of said membrane and a second region on an opposite side of said membrane;

(g) a retentate of the solution disposed in the first region of the filter, said retentate having a first concentration of metal ions;

(h) a permeate of the solution disposed in the second region of the filter, said permeate having a second concentration of metal ions lower than the first concentration;

(i) a return means operative to return said retentate to said reservoir; and (j) an ion-exchange resin in fluid communication with said filter, said ion-exchange resin adapted to receive said permeate and operative to remove metal ions therefrom.

* * * * *